US005761563A

United States Patent [19]

Earle

[11] Patent Number: 5,761,563

[45] Date of Patent: Jun. 2, 1998

[54] PHOTOGRAPHIC PROCESSING APPARATUS

[75] Inventor: Anthony Earle, Harrow Weald, England

[73] Assignee: Eastman Kodak Company, Rochester, N.Y.

[21] Appl. No.: 799,160

[22] Filed: Feb. 14, 1997

[30] Foreign Application Priority Data

Feb. 21, 1996 [GB] United Kingdom ..... 9603679

[51] Int. Cl.[6] ..... G03D 3/08

[52] U.S. Cl. ..... 396/615; 396/636

[58] Field of Search ..... 396/578, 567–570, 396/612, 615, 616, 620, 631, 636; 226/108, 119, 189, 171

[56] References Cited

U.S. PATENT DOCUMENTS

| | | | |
|---|---|---|---|
| 4,019,667 | 4/1977 | Falomo | 226/171 |
| 4,967,222 | 10/1990 | Nitsch | 396/616 |
| 4,975,723 | 12/1990 | Hammerquist et al. | 396/570 |
| 5,461,448 | 10/1995 | Eeles et al. | 396/615 |

FOREIGN PATENT DOCUMENTS

| | | |
|---|---|---|
| 0 603 951 | 6/1994 | European Pat. Off. . |
| 1 357 911 | 6/1974 | United Kingdom . |

*Primary Examiner*—D. Rutledge
*Attorney, Agent, or Firm*—Frank Pincelli; David A. Novais

[57] ABSTRACT

Described herein is an improved variable speed processor (10) in which the path length for material to be processed can be varied in a processing tank whilst maintaining a substantially constant volume of processing solution in that tank. The processor (10) comprises a plurality of processing tanks (12.14.16) in which a respective movable rack member (42.44.46) is located, each rack member (42.44.46) extending through bottom wall (52.54.56) of its associated tank (12.14.16). The path length is determined by the relative position of roller (32.34.36) mounted on rack member (42.44.46) with respect to a fixed location in the processing tank (12.14.16). For path lengths shorter than the maximum for a particular processing tank, the rack member (42.44.46) acts as a spacer in the tank (12.14.16) to maintain the volume of processing solution at a substantially constant level.

3 Claims, 2 Drawing Sheets

PHOTOGRAPHIC PROCESSING APPARATUS

FIELD OF THE INVENTION

The present invention relates to improvements in or relating to a photographic processing apparatus, and is more particularly concerned with variable speed processing apparatus having a high throughput.

BACKGROUND OF THE INVENTION

It is known to link photographic processors to printers to form high-speed printer/processor units in which a continuous web of photographic paper is used in both stages of the unit at the same time. These units allow a streamlined printing and processing operation. These processors are not normally self-threading and a "leader" is attached to the leading end of the photographic paper to be processed, on start-up, to pull it through the initial part of the unit, the photographic paper being in web form.

However, the output of printers can vary due to the type of work being printed, and when processing of the photographic paper stops, a further "leader" may be attached to the end of the paper web and remains in the apparatus until it is next required for processing. At this point, more photographic paper for processing can be attached to the free end of the "leader". This is often inconvenient, especially when there are unscheduled stops in the processing of the photographic paper.

In order to allow for situations when printing stops temporarily, means are provided to store an accumulated length of paper between the printer and processor. A "buffer" length of paper is employed to allow the output rate from the printer to be temporarily different to that of the processor. Usually the "buffer" length is produced by a magazine of rollers (sometimes called an "elevator") whose spacing can be varied to vary the total path length. Such magazines are complex and expensive to manufacture and require maintenance.

However, when the printing rate slows for a long period, for instance, when a series of reprints are required, which necessitates the printer searching for the correct negative rather than printing each negative in a roll, the "buffer" length would need to be excessively long or the paper processing would need to be frequently interrupted.

Processors which employ "elevator" magazines are known as variable speed processors and allow the output rate of the processor to vary so that variations in printer output can be matched within predetermined limits. The Agfa variable speed processor ("VSP") processor is an example of a processor in which a variation in path length is used to achieve a variable throughput. The linear speed of the web of photographic paper is adjusted according to the changing path length so that process times are kept constant.

Copending U.S. application Ser. No. 08/762,224, filed Dec. 9, 1996, entitled IMPROVEMENTS IN OR RELATING TO PHOTOGRAPHIC PROCESSING APPARATUS, by Garth B. Evans and Anthony Earle (Attorney Docket No. 72447/F-P), discloses one method of varying the transport speed of the paper web through processing apparatus which is compensated for by appropriate changes in processing solution activity. This allows the time required for processing to be varied and hence the linear speed of the paper web can be varied to allow for variations in output.

Problem to be Solved by the Invention

In variable speed processors, as the path length is adjusted by lifting the bottom roller in the processing tank to reduce the path length through the processing solution, the transport speed of the photographic material through the processing tank is also reduced. This has the result that the effective volume of the processing solution within the processing tank is adversely increased, that is, the ratio of the volume of processing solution to path length increases. This means that unstable processing chemistry cannot be used without incurring a cost penalty due to wastage of processing solutions.

Moreover, in many variable speed processors, it is difficult to achieve low volumes of processing solution, low replenishment rates, and low effluent levels whilst still maintaining optimum processing results.

With large volumes of processing solution, solution residence times (which is proportional to the ratio of tank volume to replenishment rate per unit time) tend to be high and this has an effect on the replenishment of the components making up the processing solution which deteriorate or exhausted due to aging effects. Aging effects may be due to atmospheric interactions, for example, aerial oxidation or acidification, or due to the use of solution formulations which use chemically unstable compounds or mixtures, for example, processing chemistry utilizing redox amplification chemistry wherein hydrogen peroxide is used to provide additional image dye in a developer solution, or as a bleach in a subsequent processing bath.

Furthermore, large volumes of wash water or stabilizing solution are currently used to overcome the effects of bio-growth. However, this consumes large volumes of water which then has to be treated with chemicals, using expensive equipment, in order for the water to be re-used, otherwise the water is wasted. Large energy losses may also result.

SUMMARY OF THE INVENTION

It is an object of the present invention to provide a variable speed processor in which low volumes of processing solution can be utilized while maintaining optimum processing results.

It is a further object of the present invention to keep the volume of the processing solution within the processing tank substantially constant while reducing and increasing the path length therethrough so that processing solution is not required to be added or removed thus wasting solution.

In accordance with one aspect of the present invention, there is provided a method of processing photographic material in processing apparatus which comprises at least one processing tank containing processing solution and in which a rack member is located, the rack member carrying at least one roller around which material to be processed passes during processing, the processing apparatus having a variable path length for at least one of the processing tanks, characterized in that the volume of processing solution in the processing tank remains substantially constant regardless of the path length of the material being processed.

In accordance with a second aspect of the present invention, there is provided photographic processing apparatus for processing photographic material, the apparatus comprising:

at least one processing tank containing processing solution; and a rack member mounted in each processing tank and carrying at least one roller around which material to be processed passes;

characterized in that each rack member is movable with respect to its associated tank so as to reduce the path length for the material being processed, and in that the volume of the processing solution in the associated processing tank remains substantially constant.

By "tank volume" or "processing solution volume" is meant the volume of the solution within the processing tank/channel together with that of the associated recirculation system, which includes, for example, pipework, valves, pumps, filter housings, etc.

Advantageously, the movable rack member extends through a bottom wall of its associated processing tank, said at least one roller being located in a position substantially in the middle of the rack member.

Advantageous Effect of the Invention

In accordance with the present invention, solution residence times can be substantially reduced in accordance with reductions in path length due to reductions in the volume of the processing solution for a particular processing tank.

Lower volumes of processing solutions can also be implemented in processing stages other than developer, bleach or bleach-fix stages. In particular, low volumes in wash or stabilizing stages of a photographic process reduces the opportunity for growth of bacteria, etc. The use of low volume tanks in the wash or stabilizing stage allows a series of tanks, typically between two to four tanks for minilabs, to be used which are connected together so that there is counter-current flow of the wash or stabilizing solution from the last tank in the series to the first, the wash or stabilizing solution being introduced into the last tank. (The terms "last" and "first" refer respectively to the order in which the material being processed encounters these tanks.) More tanks are needed where the processed material and the drive belts carry more than the minimum solution over to subsequent stages, for example, in larger multi-strand, high speed processors. Typically, five or six tanks are used; a low flow wash tank being located immediately after the fixing stage.

Moreover, by having a movable rack member in each processing tank which carries the bottom roller, the rack member acting as a spacer in the processing tank regardless of its relative position therein to maintain the volume of processing solution in the processing tank at a substantially constant level.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
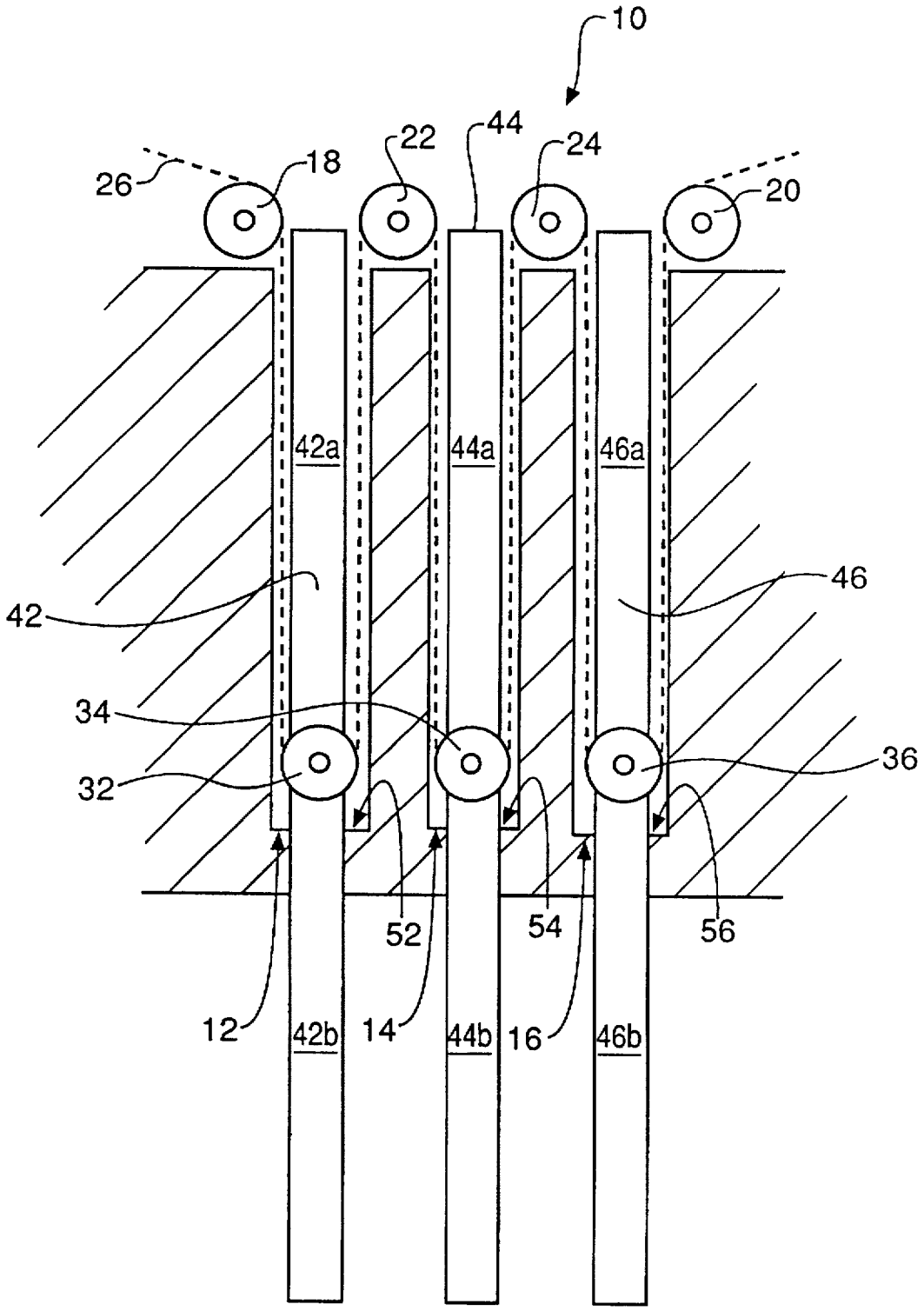
FIG. 1 is a schematic illustration of processing apparatus in accordance with the present invention.

The present invention is concerned with photographic processing apparatus which is used particularly for the production of color prints using chromogenic silver halide materials, usually papers, in web form. However, it will be readily appreciated that the present invention can be applied to any photographic processing apparatus in which there is a relatively high work throughput (for example, prints per hour).

While a processor is continuously being used, the residence time of the solutions therein is a function of processing time, processing tank dimensions, and the fraction of the paper path occupied by paper. The solution residence time can be therefore be expressed as follows:

$$\text{residence time} \propto \frac{T_T \cdot T_P}{R_R \cdot W_O}$$

wherein:

$T_T$ is the effective tank thickness;

$T_P$ is the process time (path length for a given process time is not important since as path length increases volume increases but so does the rate of addition of replenishment solutions per unit time);

$R_R$ is the replenishment rate per area of material processed; and $W_O$ is the average fraction of the maximum width of material that can be processed which is occupied by the material being processed.

As used herein, the term "effective tank thickness" for a particular processing tank is the ratio of the processing solution volume, as hereinbefore defined, of a processing stage to the product of the maximum width of the photographic material processed and the path length taken by the photographic material through the processing solution within the tank.

Low solution replenishment rates are desirable since they minimize inefficiencies in chemical use and reduce the chemical effluent and volumes of effluent. Methods of addition of replenishment chemicals directly to processing solutions are well known which allow components of a solution to be kept separate from one other until mixing occurs in the solution in the processing tank. This avoids a chemical mixing operation for replenishment solutions and allows volumes of replenishment solutions to be minimized. The residence times of tank solutions is however increased as replenishment rates are reduced thus making low tank volumes more valuable.

In accordance with the present invention, a photographic processor is provided for processing webs of color paper, the transport speed of the paper web being variable. An example of such a processor is shown schematically in FIGS. 1 and 2.

In the figures, a processor 10, in accordance with the present invention, comprises three processing stages 12,14, 16, each comprising a single processing tank. Naturally, each processing stage is not limited to a single processing tank and may comprise multiple tanks. Each processing stage 12,14,16 comprises a low volume processor having an "effective tank thickness" $T_T$ of less than 25 mm, preferably less than 11 mm, more preferably less than 3 mm.

The processor 10 has an inlet transport roller 18 located at the entrance to tank 12 and an outlet transport roller 20 located at the exit to tank 16. Transport rollers 22,24 are provided between respective ones of tanks 12,14 and 14,16 as shown. Each processing tank 12,14,16 includes a respective roller 32,34,36 around which material 26 to be processed passes as shown by the dotted lines.

Each roller 32,34,36 is mounted on a movable rack member 42,44,46 within a respective one of the processing tanks 12,14,16. As shown in the Figures, each rack member 42,44,46 extends through a bottom wall 52,54,56 of a respective one of the tanks 12,14,16, with portions 42*a*,44*a*, 46*a* above respective ones of rollers 32,34,36 and portions 42*b*,44*b*,46*b* below respective ones of rollers 32,34,36. Rollers 32,34,36 can be located at any suitable position along respective rack members 42,44,46, but for maximum flexibility, rollers 32,34,36 are located substantially halfway along their associated rack members 42,44,46.

Although a single roller 32,34,36 is shown for each rack member 42,44,46, it will be appreciated that further rollers (not shown) may be provided in portions 42a,44a,46a of the rack members 42,44,46 as required to assist with transportation of the material being processed or agitation of the processing solution at the surface of the material.

Naturally, suitable sealing means (not shown) is provided in each of the processing tanks 12,14,16 around portions 42b,44b,46b of the rack members 42,44,46 in the vicinity of the bottom wall 52,54,56 of the tanks 12,14,16 to prevent solution leaking therefrom.

In FIG. 1, each rack member 42,44,46 is shown in the position which provided the longest path length for the material 26 being processed, that is, with rollers 32,34,36 located adjacent the bottom wall 52,54,56 of respective ones of the tanks 12,14,16.

Figure 2:
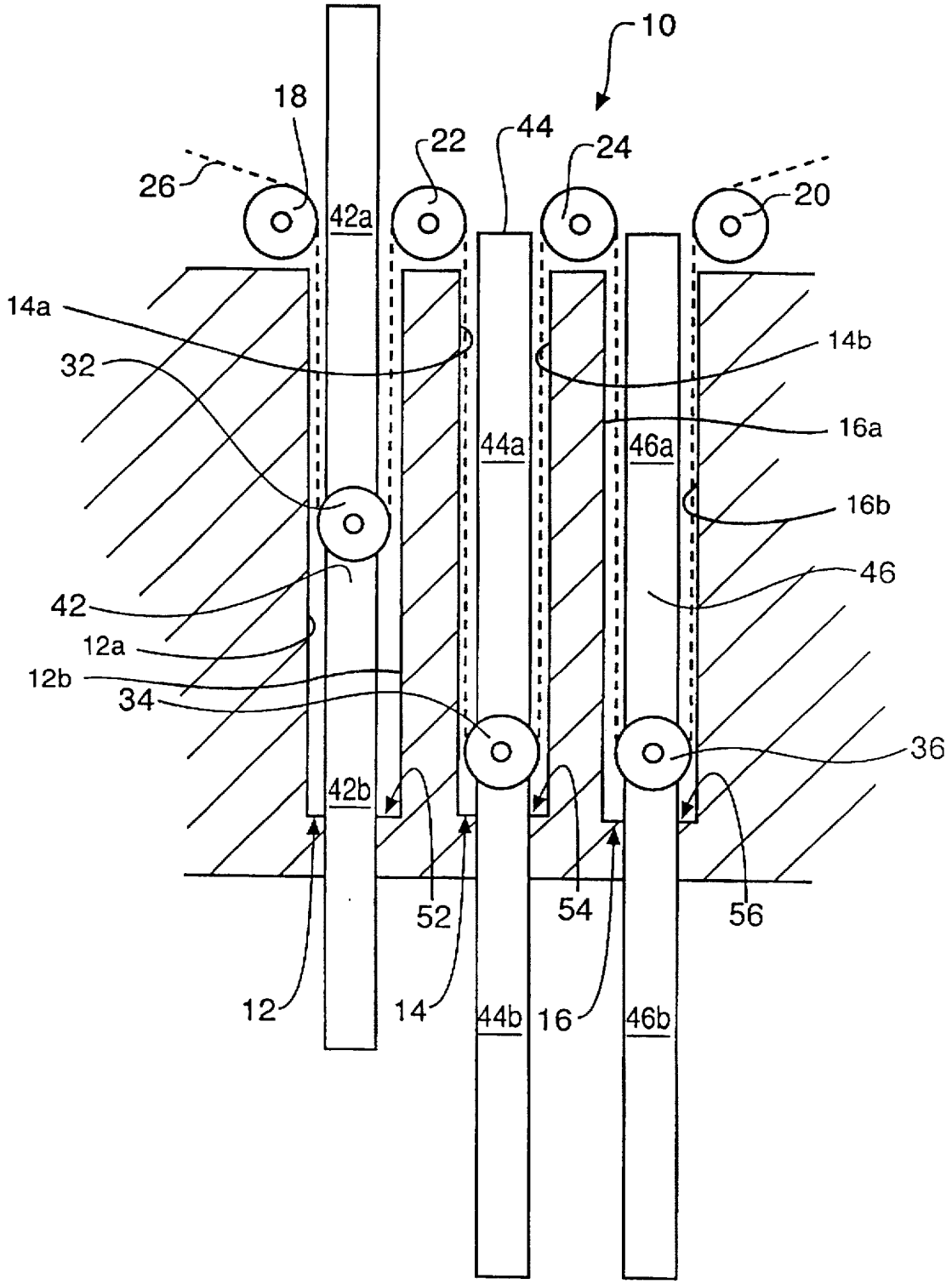
FIG. 2 is similar to FIG. 1, but illustrates one processing tank of the apparatus having a reduced path length.

In FIG. 2, tank 12 is shown with a shorter path length. Here, the rack member 42 has been moved upwards to shorten the path length. This means that more of portion 42b of rack member 42 now extends above the bottom wall 52 of the tank 12 with an upper part of portion 42a extending above the tank 12.

It will be appreciated that, as the rack member 42 moves from the position shown in FIG. 1 to that shown in FIG. 2, the volume of processing solution (not shown) in the tank 12 will remain substantially constant as the same amount of the rack member 12 is in the processing tank 12. This means that it is possible to operate the processing tank with a low volume of processing solution to overcome the need to remove and replace processing solution in the tank 12 so that the material can be processed satisfactorily.

By the term "low volume" is meant that the effective tank thickness, as hereinbefore defined, is less than 25 mm, as discussed above.

Surface texturing may be provided on walls 12a,12b,14a,14b,16a,16b of the tanks 12,14,16 to prevent the material 26 sticking thereto as tension on the material 26 varies due to changes in path length. Surface texturing may also be provided on rack member 42,44,46 if required.

Suitable means for providing agitation of the processing solution (not shown) at the surface of the material 26 while in the processing tanks 12,14,16 may also be provided. For example, adequate agitation may be achieved by providing high velocity solution flow directed at the material surface. This can be provided by the use of slot nozzles (not shown) which are built into the walls 12a,12b,14a,14b,16a,16b of the processing tanks 12,14,16 and through which the processing solutions are recirculated at high rates using large capacity pumps to provide the necessary flow rates. This recirculation also ensures that the volume of solutions is fully mixed and has uniform concentrations of components but the flow rates needed to ensure good mixing are lower than that needed to provide impingement agitation. The delivery of liquid to slot nozzles is typically provided by tubes or channels which allow uniform flow of solution along the length of the nozzles.

Alternatively, or additionally, slot nozzles may also be provided in the rack member 42,44,46 and connected for recirculation using suitable fluid connections.

It is to be understood that various other changes and modifications may be made without departing from the scope of the present invention. The present invention being limited by the following claims.

Parts List:

10 . . . processor
12,14,16 . . . tank
12a,12b,14a,14b,16a,16b . . . walls
18 . . . inlet transport roller
20 . . . outlet transport roller
22,24 . . . transport rollers
26 . . . material
32,34,36 . . . roller
42,44,46 . . . movable rack member
42a,44a,46a . . . portions
42b,44b,46b . . . portions
52,54,56 . . . bottom wall

I claim:

1. A method of processing photographic material in a processing apparatus which comprises at least one processing tank containing processing solution and in which a rack member is located, the rack member carrying at least one roller around which material to be processed passes during processing, the method comprising the step of varying a path length for at least one of the processing tanks by moving a rack member with respect to its associated tank, wherein the rack member extends through a bottom wall of the associated tank, such that the volume of processing solution in the processing tank remains substantially constant regardless of the path length of the material being processed.

2. Photographic processing apparatus for processing photographic material, the apparatus comprising:

at least one processing tank containing processing solution, and a rack member mounted in each processing tank and carrying at least one roller around which material to be processed passes, characterized in that each rack member is movable with respect to its associated tank so as to reduce the path length for the material being processed, and in that the volume of the processing solution in the associated processing tank remains substantially constant;

wherein the movable rack member extends through a bottom wall of its associated processing tank, said at least one roller being located in a position substantially in the middle of the rack member.

3. An apparatus according to claim 2, wherein the apparatus has an effective tank thickness equal to or less than 25 mm.

* * * * *